US007391401B2

(12) United States Patent
Kim et al.

(10) Patent No.: US 7,391,401 B2
(45) Date of Patent: Jun. 24, 2008

(54) LIQUID CRYSTAL DISPLAY, AND APPARATUS AND METHOD OF DRIVING LIQUID CRYSTAL DISPLAY

(75) Inventors: Dong-Hwan Kim, Yongin (KR); Dong-Wan Choi, Seoul (KR); Bo-Young An, Yongin (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 407 days.

(21) Appl. No.: 10/728,000

(22) Filed: Dec. 3, 2003

(65) Prior Publication Data

US 2004/0196232 A1 Oct. 7, 2004

(30) Foreign Application Priority Data

Dec. 4, 2002 (KR) ..... 10-2002-0076605

(51) Int. Cl.
*G09G 3/36* (2006.01)

(52) U.S. Cl. ..... 345/96; 345/209; 345/690

(58) Field of Classification Search ..... 345/94–96, 345/100, 209–210, 690
See application file for complete search history.

(56) References Cited

U.S. PATENT DOCUMENTS

| | | | | |
|---|---|---|---|---|
| 2001/0046002 | A1 | 11/2001 | Lin et al. | |
| 2002/0097214 | A1 * | 7/2002 | Song | 345/96 |
| 2002/0113768 | A1 | 8/2002 | Lin et al. | |
| 2003/0090448 | A1 * | 5/2003 | Tsumura et al. | 345/87 |

FOREIGN PATENT DOCUMENTS

| | | |
|---|---|---|
| JP | 10-073843 | 3/1998 |
| JP | 10-171412 | 6/1998 |
| JP | 10-213814 | 8/1998 |
| JP | 1998-076166 | 11/1998 |
| JP | 11-030789 | 2/1999 |
| JP | 2001-21549 | 8/2001 |
| JP | 2001-242477 | 9/2001 |
| JP | 2002-23683 | 1/2002 |
| JP | 2002-023709 | 1/2002 |
| KR | 100218525 | 6/1999 |
| KR | 1019990080838 | 11/1999 |
| KR | 2002-0017434 | 3/2002 |

(Continued)

OTHER PUBLICATIONS

English Language Abstract, JP Patent First Publication No. 10-073843, Mar. 17, 1998, 1 page.

(Continued)

*Primary Examiner*—Amr A. Awad
*Assistant Examiner*—Michael Pervan
(74) *Attorney, Agent, or Firm*—MacPherson Kwok Chen & Heid LLP

(57) ABSTRACT

An apparatus for driving a liquid crystal display includes a data driver alternately applying first data voltages and second voltages to pixels for a horizontal period and a signal controller changing a state of an inversion signal between an end of the transmission of first image data corresponding to the first data voltages and a start of the transmission of second image data corresponding the second data voltages and the polarity of the common voltage between an end of the application of the data voltages for a row and a start of the application of the data voltages for a next row.

12 Claims, 6 Drawing Sheets

FOREIGN PATENT DOCUMENTS

| | | |
|---|---|---|
| KR | 2002-0050040 | 6/2002 |
| KR | 10-275954 | 9/2002 |

OTHER PUBLICATIONS

English Language Abstract, JP Patent First Publication No. 10-171412, Jun. 26, 1998, 1 page.

English Language Abstract, JP Patent First Publication No. 10-213814, Aug. 11, 1998, 1 page.

English Language Abstract, US Patent First Publication No. 6,069,600, May 30, 2000, (counterpart to JP 11-30789, Feb. 2, 1999) 1 page.

English Language Abstract, US Patent First Publication No. 2001/0043178, Nov. 22, 2001, (counterpart to JP 2001-215469, Aug. 10, 2001) 1 page.

English Language Abstract, US Patent First Publication No. 2001/0033265, Oct. 25, 2001, (counterpart to JP 2001-242477, Sep. 17, 2001) 1 page.

English Language Abstract, US Patent First Publication No. 2002/0044127, Apr. 18, 2002, (counterpart to JP 2002-23683, Jan. 23, 2002) 1 page.

English Language Abstract, JP Patent First Publication No. 2002-023709, Jan. 25, 2002, 1 page.

English Language Abstract, KR Patent First Publication No. 100218525, Jun. 10, 1999, 1 page.

English Language Abstract, KR Patent First Publication No. 10-275954, Sep. 25, 2002, 1 page.

English Language Abstract, US Patent First Publication No. 6,064,363, May 16, 2000 (counterpart to KR 1998-076166, Nov. 16, 1998) 1 page.

English Language Abstract, KR Patent First Publication No. 1019990080838, Nov. 15, 1999, 1 page.

English Language Abstract, US Patent First Publication No. 2002/0047820, Apr. 25, 2002 (counterpart to KR 2002-0017434, Mar. 7, 2002) 1 page.

English Language Abstract, US Patent First Publication No. 2002/0075212, Jun. 20, 2002 (counterpart to KR 2002-0050040, Jun. 26, 2002) 1 page.

* cited by examiner

LIQUID CRYSTAL DISPLAY, AND APPARATUS AND METHOD OF DRIVING LIQUID CRYSTAL DISPLAY

RELATED APPLICATION

This patent application claims priority from Korean Patent Application No. 2002-0076605 filed on Dec. 4, 2002, which is incorporated herein by reference in its entirety.

BACKGROUND OF THE INVENTION (a) Field of the Invention

The present invention relates to a liquid crystal display, and an apparatus and method for driving the liquid crystal display.

(b) Description of the Related Art

Liquid crystal displays (LCDs) include two panels having pixel electrodes and a common electrode and a liquid crystal (LC) layer with dielectric anisotropy, which is interposed between the two panels. The liquid crystal layer is applied with electric field by applying voltages to the two electrodes, and the transmittance of light passing through the liquid crystal layer is adjusted by controlling the electric field, thereby obtaining desired images. The pixel electrodes are arranged in a matrix and connected to switching elements such as thin film transistors (TFTs). The switching elements selectively transmit data voltages from data lines in response to gate signals from gate lines. The common electrode covers entire surface of one of the two panels and is supplied with a common voltage.

In order to prevent image deterioration due to long-time application of the unidirectional electric field, polarity of data voltages with respect to the common voltage is reversed every frame, every row, or every dot. Along with the polarity inversion of the data voltages, a common voltage modulation is used to reduce power consumption. The common voltage modulation is to change the magnitude of the common voltage in synchronization with the polarity inversion of the data voltages instead of fixing the magnitude of the common voltage, thereby reducing the amplitude of the data voltages.

However, as described above, since the common electrode covers entire surface of one of the two panels, the magnitude of the common voltage applied to adjacent pixels may not be different. Therefore, the magnitude of the common voltage applied to the pixels in one row supplied with the data voltages at the same time should be equal, and thus the common voltage modulation may be not used for a dot inversion LCD.

In a line inversion LCD, different pixel rows are supplied with the data voltages at different times and the magnitude of the common voltage may be changed every row using the common voltage modulation. In this case, image data for a row from a signal controller are sequentially stored into a data driver together with an inversion signal for determining the polarity of the image data, and they are applied to the LCD panel assembly when all the image data for the row are stored into the data driver after one horizontal period from the start of the data storing. However, because the common voltage is directly applied to the LCD panel assembly not through the data driver, the inversion signal is delayed by a horizontal period than the periodic common voltage.

In the meantime, the line inversion often enhances flicker phenomenon. In an LCD for a cellular phone, etc., having a small display screen and a low operating frequency, image deterioration such as the flicker phenomenon is not a significant problem since the user hardly perceives the flicker. However, it becomes increasingly important as the size of the display screen of an LCD becomes large.

SUMMARY OF THE INVENTION

An apparatus for driving a liquid crystal display including a plurality of pixels connected to gate lines and data lines and arranged in a matrix is provided, which includes: a gray voltage generator generating a plurality of gray voltages; a data driver selecting data voltages corresponding to image data from the gray voltages and applying the data voltages to the pixels; and a signal controller transmitting the image data for the data driver and generating and outputting control signals for controlling the image data to the data driver, wherein the data voltages include first data voltages for odd pixels and second data voltages for an even pixels, the image data include the first image data for the first data voltages and the second image data for the second data voltages, the data driver applies the first data voltages and the second voltages to the pixels in turn for a horizontal period, the control signals include an inversion signal for reversing the polarity of the first and the second data voltages and a common voltage applied to the pixels having a magnitude varying dependent on the polarity of the data voltages, and the signal controller changes a state of the inversion signal between an end of the transmission of the first image data and a start of the transmission of the second image data and the polarity of the common voltage between an end of the application of the data voltages for a row and a start of the application of the data voltages for a next row.

A phase of the common voltage is preferably delayed by half of a horizontal period with respect to a phase of the inversion signal.

A period of the inversion signal and a period of the common voltage are preferably equal to two horizontal periods.

According to an aspect of the present invention, a liquid crystal display is provided, which includes: a plurality of pixels arranged in a matrix; a plurality of odd and even data lines and gate lines transferring signals to the pixels; a gray voltage generator generating a plurality of gray voltages; a data driver selecting data voltages corresponding to image data from the gray voltages and applying the data voltages to the pixels; and a transmission gate unit including a plurality of odd switching elements connected to the odd data lines and a plurality of even switching element connected to the even data lines, and connected to the data driver; and a signal controller transmitting the image data to the data driver and generating and outputting control signals for controlling the image data to the data driver and the transmission gate unit, wherein the odd switching elements and the even switching elements are connected to each other in pairs, the data voltages include first data voltages for odd pixels and second data voltages for an even pixels, the image data include the first image data for the first data voltages and the second image data for the second data voltages, the data driver applies the first data voltages and the second voltages to the pixels in turn for a horizontal period, the signal controller controls the transmission gate unit to alternately turn on the odd switching elements and the even switching elements such that the first data voltages and the second data voltages are applied to the corresponding pixels, the control signals include an inversion signal for reversing the polarity of the first and the second data voltages and a common voltage applied to the pixels having a magnitude varying dependent on the polarity of the data voltages, and the signal controller changes a state of the inversion signal between an end of the transmission of the first image data and a start of the transmission of the second image data and the polarity of the common voltage between an end of the application of the data voltages for a row and a start of the application of the data voltages for a next row.

A phase of the common voltage is preferably delayed by half of a horizontal period with respect to a phase of the inversion signal.

A period of the inversion signal and a period of the common voltage are preferably equal to two horizontal periods.

Preferably, the control signals further includes a first switching driving signal driving the odd switching elements and a second switching driving signal driving the even switching elements, and the signal controller alternately applies the first switching driving signal and the second driving signal to the odd switching elements and the even switching elements.

According to another aspect of the present invention, a liquid crystal display is provided, which includes: a plurality of odd and even pixels and arranged in a matrix, each pixel including a switching element; a plurality of first gate lines connected to the odd pixels; a plurality of second gate lines connected to the even pixels; a plurality of data lines connected to the pixels; a gray voltage generator generating a plurality of gray voltages; a first gate driver connected to the first gate lines to drive the switching elements of the odd pixels; a second gate driver connected to the second gate lines to drive the switching elements of the even pixels; a data driver selecting data voltages corresponding to image data from the gray voltages and applying the data voltages to the pixels; and a signal controller transmitting the image data to the data driver and generating and outputting control signals for controlling the image data to the data driver, wherein the data voltages include first data voltages for odd pixels and second data voltages for an even pixels, the image data include the first image data for the first data voltages and the second image data for the second data voltages, each pair of the first and the second gate lines connected to the odd and even pixels in a row are alternately supplied with a gate-on voltage from the first and the second gate drivers, respectively, to turn on the switching elements connected thereto for one horizontal period, the data driver outputs the first voltages for the odd pixels during a period that the first switching elements are turned on and outputs the second voltages for the even pixels during a period that the second switching elements are turned on, the control signals include an inversion signal for reversing the polarity of the first and the second data voltages and a common voltage applied to the pixels having a magnitude varying dependent on the polarity of the data voltages, and the signal controller changes a state of the inversion signal between an end of the transmission of the first image data and a start of the transmission of the second image data and the polarity of the common voltage between an end of the application of the data voltages for a row and a start of the application of the data voltages for a next row.

A phase of the common voltage is preferably delayed by half of a horizontal period with respect to a phase of the inversion signal.

A period of the inversion signal and a period of the common voltage are preferably equal to two horizontal periods.

The odd pixels and the even pixels are preferably connected to the data lines in pairs.

A method of driving the liquid crystal display including a plurality of odd and even pixels arranged in a matrix is provided, which includes: supplying image data for the odd pixels, an inversion signal, and a common voltage; reversing a state of the inversion signal; supplying image data for the even pixels; and reversing a state of the common voltage.

BRIEF DESCRIPTION OF THE DRAWINGS

The present invention will become more apparent by describing embodiments thereof in detail with reference to the accompanying drawings in which.

DETAILED DESCRIPTION OF EMBODIMENTS

Figure 1:
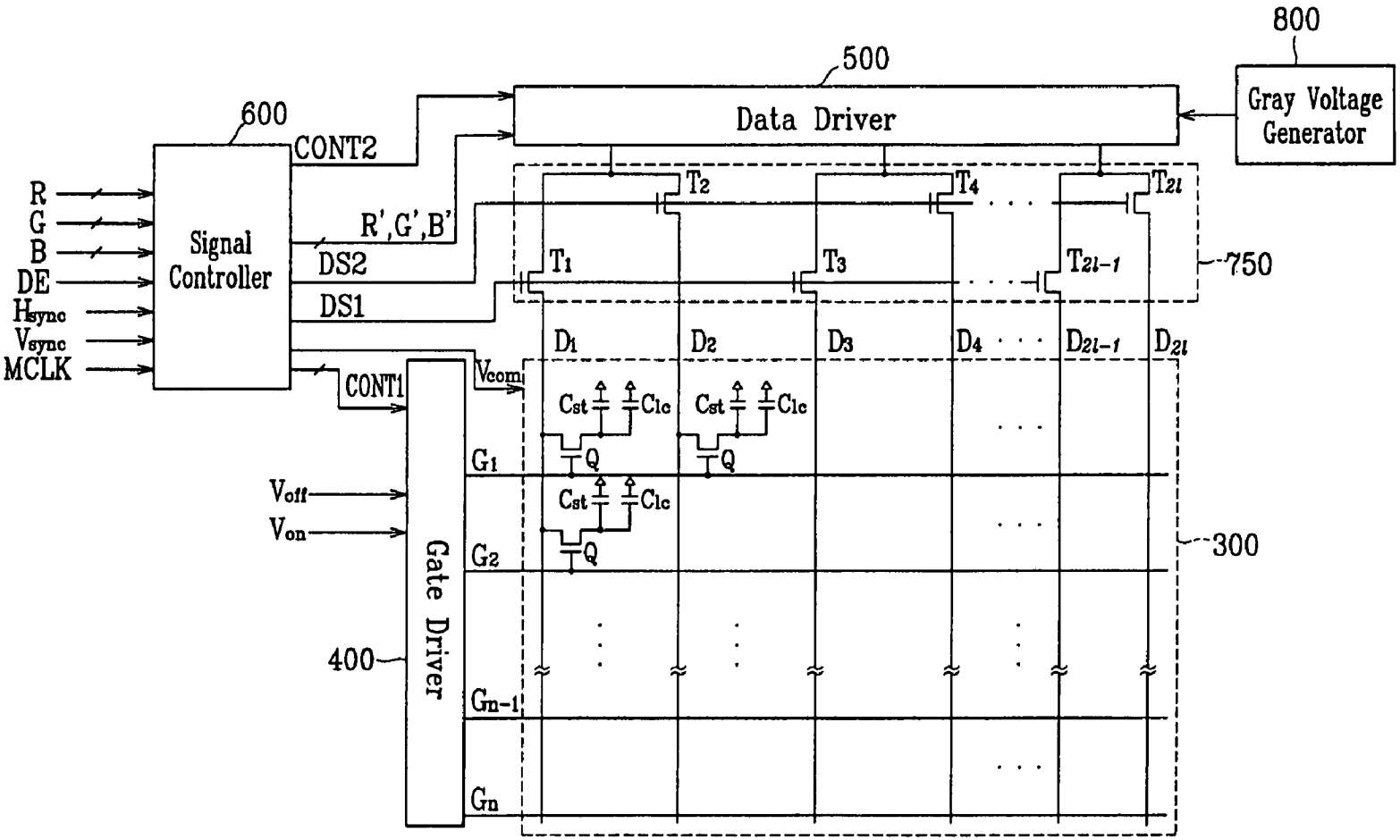
FIG. 1 is a block diagram of an LCD according to an embodiment of the present invention.

The present invention now will be described more fully hereinafter with reference to the accompanying drawings, in which embodiments of the invention are shown. This invention may, however, be embodied in many different forms and should not be construed as limited to the embodiments set forth herein. Like numerals refer to like elements throughout.

In the drawings, the thickness of layers and regions are exaggerated for clarity. Like numerals refer to like elements throughout. It will be understood that when an element such as a layer, region or substrate is referred to as being "on" another element, it can be directly on the other element or intervening elements may also be present. In contrast, when an element is referred to as being "directly on" another element, there are no intervening elements present.

Then, LCDs, apparatus and methods for driving the LCDs according to embodiments of the present invention will be described with reference to the accompanying drawings.

Figure 2:
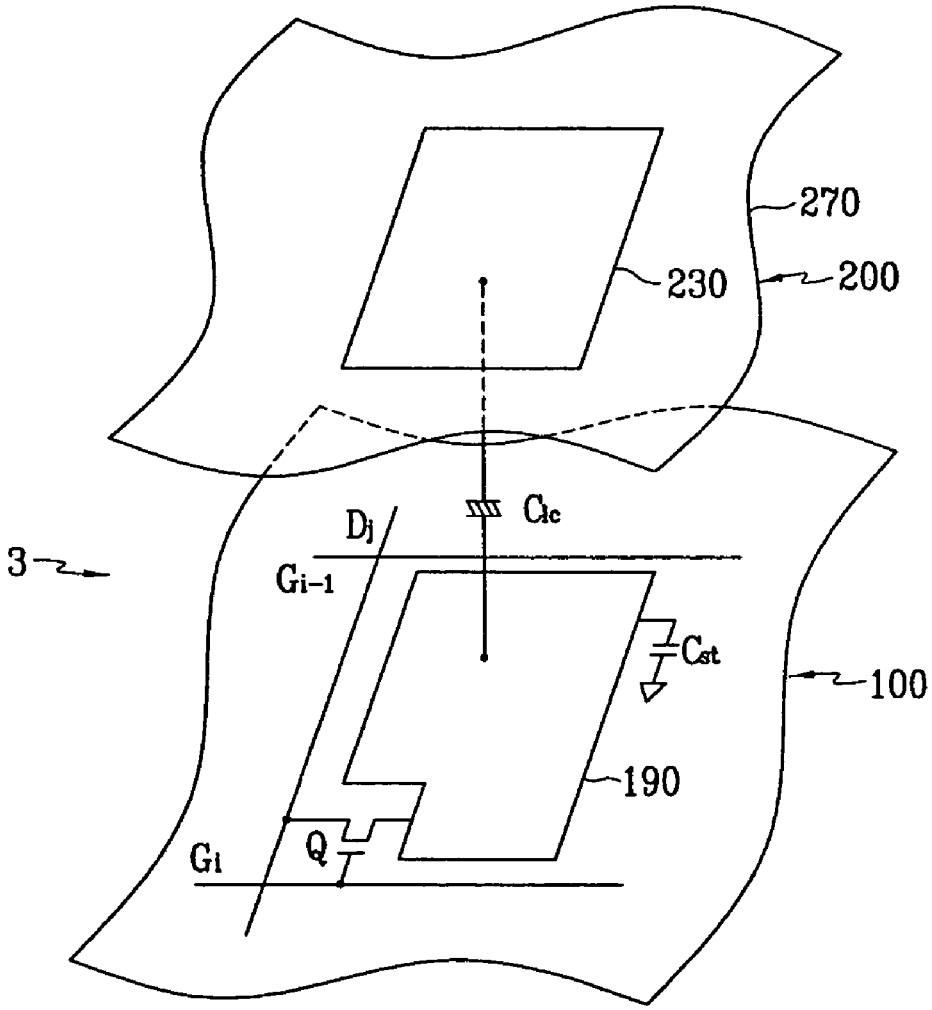
FIG. 2 is an equivalent circuit diagram of a pixel of an LCD according to an embodiment of the present invention.
Figure 3:
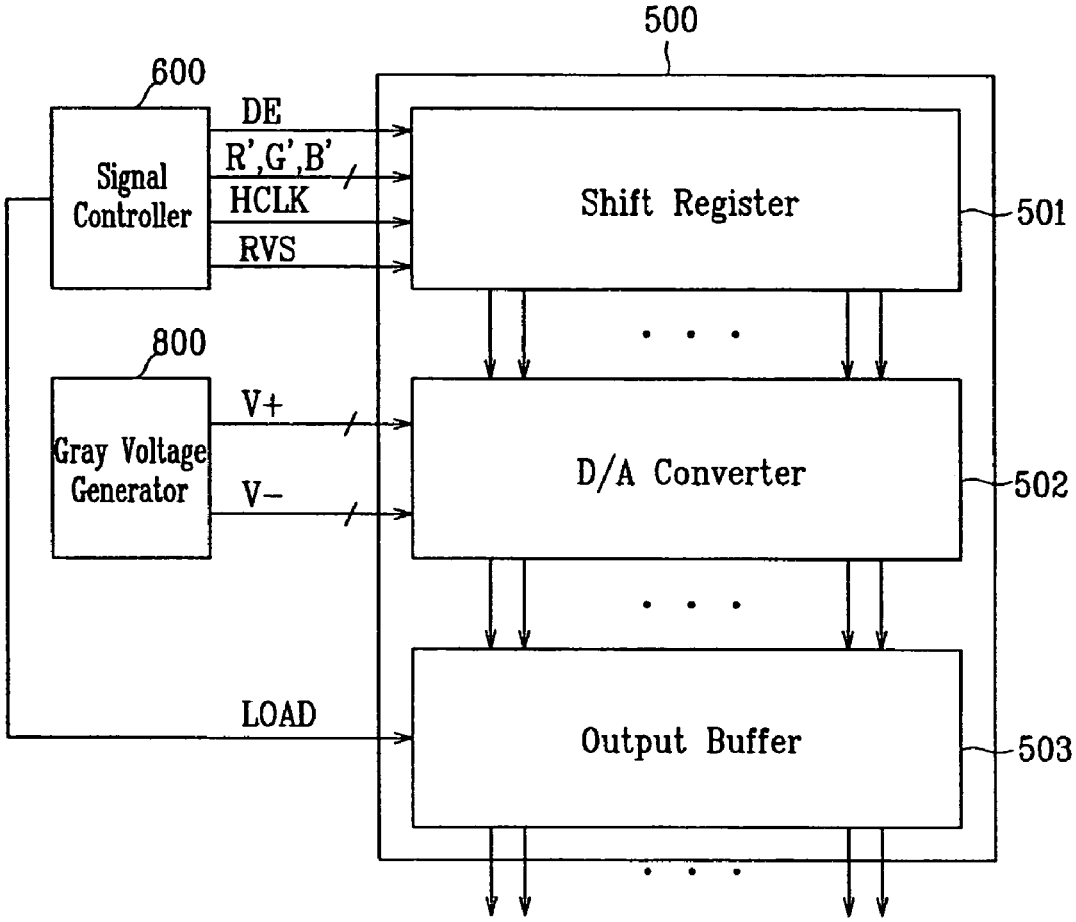
FIG. 3 is a block diagram of a data driver of an LCD according to an embodiment of the present invention.

FIG. 1 is a block diagram of an LCD according to an embodiment of the present invention, and FIG. 2 is an equivalent circuit diagram of a pixel of an LCD according to an embodiment of the present invention. FIG. 3 is a block diagram of a data driver of an LCD according to an embodiment of the present invention.

Referring to FIG. 1, an LCD according to an embodiment of the present invention, which is a transmission gate type LCD, includes an LC panel assembly 300, a gate driver 400 and a transmission gate unit 750 which are connected to the panel assembly 300, a data driver 500 connected to the transmission gate unit 750, a gray voltage generator 800 connected to the data driver 500, and a signal controller 600 controlling the above elements.

In circuital view, the LC panel assembly 300 includes a plurality of display signal lines $G_1$-$G_n$ and $D_1$-$D_m$ and a plurality of pixels connected thereto and arranged substantially in a matrix.

The display signal lines $G_1$-$G_n$, and $D_1$-$D_m$ include a plurality of gate lines $G_1$-$G_n$ transmitting gate signals (also referred to as "scanning signals"), and a plurality of data lines $D_1$-$D_m$ transmitting data signals. The gate lines $G_1$-$G_n$ extend substantially in a row direction and substantially parallel to each other, while the data lines $D_1$-$D_m$ extend substantially in a column direction and substantially parallel to each other.

Each pixel includes a switching element Q connected to the signal lines $G_1$-$G_n$ and $D_1$-$D_m$, and a LC capacitor $C_{LC}$ and a storage capacitor $C_{ST}$ that are connected to the switching element Q. If necessary, the storage capacitor $C_{ST}$ may be omitted.

The switching element Q is provided on a lower panel 100 and has three terminals, a control terminal connected to one of the gate lines $G_1$-$G_n$, an input terminal connected to one of the data lines $D_1$-$D_m$, and an output terminal connected to both the LC capacitor $C_{LC}$ and the storage capacitor $C_{ST}$.

The LC capacitor $C_{LC}$ includes a pixel electrode 190 provided on the lower panel 100 and a common electrode 270 provided on an upper panel 200 as two terminals. The LC layer 3 disposed between the two electrodes 190 and 270 functions as dielectric of the LC capacitor $C_{LC}$. The pixel electrode 190 is connected to the switching element Q and the common electrode 270 is connected to the common voltage $V_{com}$ and covers entire surface of the upper panel 200. Unlike FIG. 2, the common electrode 270 may be provided on the lower panel 100, and both electrodes 190 and 270 have shapes of bar or stripe.

The storage capacitor $C_{ST}$ is defined by the overlap of the pixel electrode 190 and a separate wire (not shown) provided on the lower panel 100 and applied with a predetermined voltage such as the common voltage $V_{com}$. Otherwise, the storage capacitor $C_{ST}$ is defined by the overlap of the pixel electrode 190 and its previous gate line $G_{i-1}$ via an insulator.

For color display, each pixel can represent its own color by providing one of a plurality of red, green and blue color filters 230 in an area corresponding to the pixel electrode 190. The color filter 230 shown in FIG. 2 is provided in the corresponding area of the upper panel 200. Alternatively, the color filters 230 are provided on or under the pixel electrode 190 on the lower panel 100.

The LC molecules in the LC capacitor $C_{LC}$ have orientations depending on the variation of electric field generated by the pixel electrode 190 and the common electrode 270, and the molecular orientations determine the polarization of light passing through the LC layer 3. A polarizer or polarizers (not shown) attached to at least one of the panels 100 and 200 convert the light polarization into the light transmittance.

Referring to FIG. 1 again, the gray voltage generator 800 generates two sets of a plurality of gray voltages V+ and V− related to the transmittance of the pixels. The gray voltages in one set have a positive polarity (+) with respect to the common voltage $V_{com}$, while those in the other set have a negative polarity (−) with respect to the common voltage $V_{com}$.

The gate driver 400 is connected to the gate lines $G_1$-$G_n$ of the LC panel assembly 300 and applies gate signals from an external device to the gate lines $G_1$-$G_n$, each gate signal being a combination of a gate-on voltage $V_{on}$ and a gate-off voltage $V_{off}$.

The data driver 500 is connected to the transmission gate unit 750 and it selects the gray voltages V+ and V− from the gray voltage generator 800 and applies the selected gray voltages as the data signals to the transmission gate unit 750. As shown in FIG. 3, the data driver 500 includes a shift register 501, a digital/analog converter (hereinafter, referred to as "D/A converter") 502 connected to the shift register 501, and an output buffer 503 connected to the D/A converter 502. The shift register 501 and the output buffer 503 are connected to the signal controller 600 and the D/A converter 502 is connected to the gray voltage generator 800.

The transmission gate unit 750 includes a plurality of transistors $T_1$-$T_{2l}$ and the number of the transistors $T_1$-$T_{2l}$ is equal to that of the data lines $D_1$-$D_{2l}$ of the panel assembly 300. Each transistor $T_1$-$T_{2l}$ has an input terminal connected to the data driver 500 and an output terminal connected to a corresponding data line $D_1$-$D_{2l}$.

The output terminals of the odd transistors $T_1, T_3, T_5, \ldots, T_{2l-1}$ are connected to the odd data lines $D_1, D_3, D_5, \ldots, D_{2l-1}$, while the output terminals of the even transistors $T_2, T_4, T_6, \ldots, T_{2l}$ are connected to the even data lines $D_2, D_4, D_6, \ldots, D_{2l}$. The input terminals of the odd transistors $T_1, T_3, T_5, \ldots, T_{2l-1}$, and the even transistors $T_2, T_4, T_6, \ldots, T_{2l}$ are connected to each other in pairs.

The control terminals of the odd transistors $T_1, T_3, T_5, \ldots, T_{2l-1}$ and the even transistors $T_2, T_4, T_6, \ldots, T_{2l}$ are supplied with different signals, for example, having a reversed relation.

Each transistor $T_1$-$T_{2l}$ in this embodiment is an N-type metal-oxide-silicon (MOS) transistor, but it may be a P-type MOS transistor.

The signal controller 600 controls the gate driver 400, the data driver 500, and the transmission gate unit 750.

Then, operations of the LCD will be described in detail.

The signal controller 600 is supplied from an external graphics controller (not shown) with RGB image signals R, G and B and input control signals controlling the display thereof, for example, a vertical synchronization signal $V_{sync}$, a horizontal synchronization signal $H_{sync}$, a main clock CLK, a data enable signal DE, etc. The signals controller 600 generates a plurality of gate control signals CONT1, a plurality of data control signals CONT2, a pair of data selection signals DS1 and DS2, and the common voltage $V_{com}$ and processes the image signals R, G and B for the LC panel assembly 300 on the basis of the input image data R, G and B and the input control signals. The signal controller 600 provides the gate control signals CONT1 for the gate driver 400, the data control signals CONT2 and the processed image signals R', G' and B' for the data driver 500, the data selection signals DS1 and DS2 for the transmission gate unit 750, and the common voltage $V_{com}$ for the LC panel assembly 300.

The gate control signals CONT1 include a vertical synchronization start signal STV for informing of start of a frame, a gate clock signal CPV for controlling the output time of the gate-on voltage $V_{on}$, and an output enable signal OE for defining the durations of the gate-on voltage $V_{on}$.

The data control signals CONT2 include a horizontal synchronization start signal STH for informing of start of a horizontal period, a load signal LOAD or TP for instructing to apply the appropriate data voltages to the data lines $D_1$-$D_m$, an inversion control signal RVS for reversing the polarity of the data voltages (with respect to the common voltage $V_{com}$), and a data clock signal HCLK.

The common voltage $V_{com}$ generated by the signal controller 600 becomes to have a predetermined level by a level shifter (not shown) and the level-shifted common voltage $V_{com}$ is supplied for the LC panel assembly 300. According to the other embodiment of the present invention, the common voltage $V_{com}$ is not generated by the signal controller 600, but by a separate common voltage generator (not shown) based on the inversion signal RVS fed from the signal controller 600.

The data driver 500 receives a packet of the image data R', G' and B' for odd pixel columns and even pixel columns from the signal controller 600, converts the image data R', G' and B' into analog data voltages selected from the gray voltages V+ and V−, and outputs the converted data voltages to the data lines $D_1$-$D_{2l}$.

Responsive to the gate control signals CONT1 from the signal controller 600, the gate driver 400 applies the gate-on voltage $V_{on}$ to the gate line $G_1$-$G_n$, thereby turning on the switching elements Q connected thereto.

At this time, the signal controller 600 supplies the data selection signal DS1 in a high state for the odd transistors $T_1$, $T_3, T_5, \ldots, T_{2l-1}$, while it supplies the data selection signal DS2 in a low state for the even transistors $T_2, T_4, T_6, \ldots, T_{2l}$. Then, the odd transistors $T_1, T_3, T_5, \ldots, T_{2l-1}$ turn on to apply the data voltages to the odd data lines $D_1, D_3, D_5, \ldots, D_{2l-1}$. Consecutively, the signal controller 600 changes the states of the data selection signals DS1 and DS2 to turn off the odd transistors $T_1, T_3, T_5, \ldots, T_{2l-1}$ and to turn on the even transistors $T_2, T_4, T_6, \ldots, T_{2l}$. Then, the data voltages are supplied to the even transistors $T_2, T_4, T_6, \ldots, T_{2l}$ connected to the even data lines $D_2, D_4, D_6, \ldots, D_{2l}$.

The relation between the state of the data selection signal DS1 or DS2 and the activation of the transistors $T_1$-$T_{2l}$ is reversed when the transistors $T_1$-$T_{21}$ are P type MOS transistors.

Then, the data voltages in turn are supplied to the corresponding pixels via the activated switching elements Q.

As a result, the data signals are supplied in turn for the odd pixels and the even pixels for one horizontal period (often indicated as "1H," which is equal to one period of the horizontal synchronization signal $H_{sync}$, the data enable signal DE, and the data clock signal CPV). At the same time, the odd pixels and the even pixels are supplied with the common voltage $V_{com}$ with different magnitudes.

By repeating this procedure, all gate lines $G_1$-$G_n$ are sequentially supplied with the gate-on voltage $V_{on}$ during a frame, and all the pixels are supplied with the data voltages.

The above-described operation will be described in detail with reference to FIGS. 3 and 4.

Figure 4:
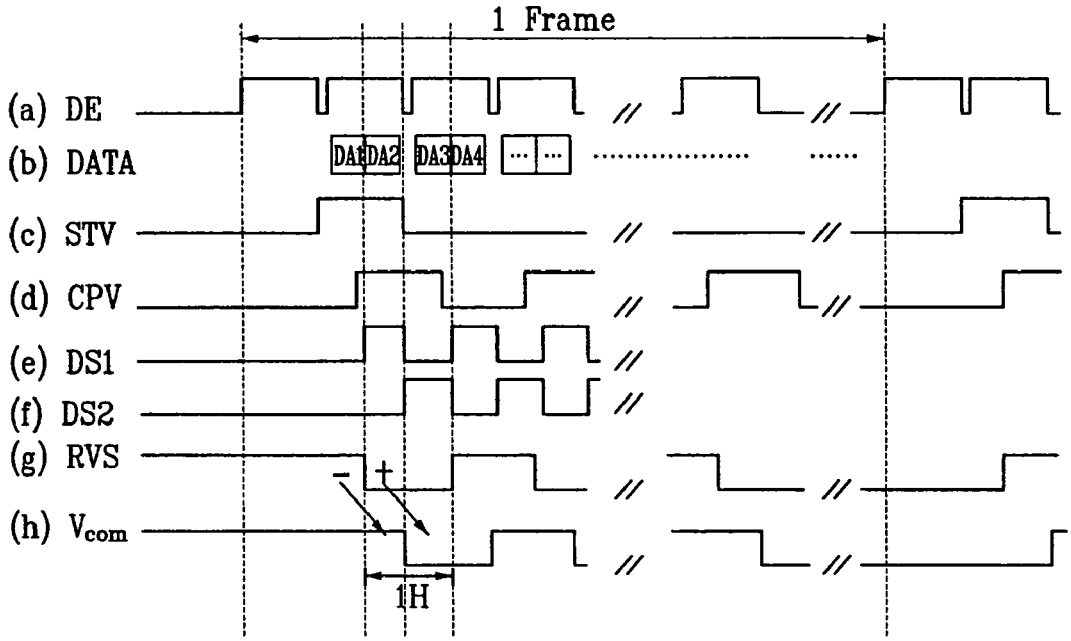
FIG. 4 is a time chart of an LCD according to an embodiment of the present invention.

FIG. 4 is a time chart of an LCD according to an embodiment of the present invention.

When the data enable signal DE applied from an external graphics controller (not shown) into the signal controller 600 is in a high state, the image data DA1 for the pixels in the odd columns are sequentially transmitted from the signal controller 600 to the data driver 500 to be stored into the shift register 501. Besides, the inversion signal RVS defining the polarity of the data voltages is stored into the shift register 501, too. Referring to FIG. 4, when the inversion signal RVS is in a high state, the data voltages corresponding to the image data have negative polarity, and vice versa. Therefore, the data voltages corresponding to the image data DA1 for the pixels in the odd columns are negative polarity. The period of the inversion signal RVS is equal to two horizontal periods.

After all the image data DA1 are stored in the shift resister 501, the image data DA1 are supplied for the D/A converter 502 together with the inversion signal RVS, such that the D/A converter 502 selects data voltages from one of two sets of the positive and the negative gray voltages V+ and V−. In FIG. 4, the D/A converter 502 selects the data voltages from the negative gray voltages V− and outputs the data voltages to the output buffer 503.

Meanwhile, when the vertical synchronization start signal STV becomes high and the time goes ½ horizontal period from the input of the image data DA1, the gate clock signal CPV is changed from a low state into a high state, and thus the gate driver 400 supplies the gate-on voltage $V_{on}$ for an appropriate gate line. In addition, the signal controller 600 applies the load signal LOAD to the output buffer 503 and changes the data selection signal DS1 to be supplied for the transmission gate unit 750 from the low state into a high state. Accordingly, the odd transistors $T_1, T_3, T_5, \ldots, T_{2l-1}$ of the transmission gate unit 750 are turned on, and the data voltages corresponding to the odd image date DA1 are applied to the odd data lines $D_1, D_3, D_5, \ldots, D_{2l-1}$ through the turned-on odd transistors $T_1, T_3, T_5, \ldots, T_{2l-1}$.

At the same time, the signal controller 600 outputs the common voltage $V_{com}$ depending on the polarity of the data voltages corresponding to the image data DA1. The common voltage $V_{com}$ has two values, a high value and a low value based on the polarity of the data voltages. The high value is chosen for the positive polarity data voltages, while the low value is chosen for the negative polarity data voltages, for reducing the amplitude of the gray voltages as described above. In FIG. 4, the common voltage $V_{com}$ has the low value because the data voltages corresponding to the image data DA1 have the negative polarity.

Accordingly, the data voltages with the negative polarity are applied to the odd pixels of the LC panel assembly 300 via the odd data lines $D_1, D_3, \ldots, D_{2l-1}$ and the common voltage $V_{com}$ applied to the LC panel assembly 300 has the high value.

During the application of the data voltages corresponding to the odd image data DA1 to the LC panel assembly 300, the shift register 501 is supplied with image data DA2 for the even pixel columns. At that time, the inversion signal RVS is changed in its state from the high state into the low state and it is stored into the shift register 501. That is, the polarity of the data voltages corresponding to the image data DA2 becomes positive.

When all the even image data DA2 are stored into the shift register 502 and the application of the odd image data DA1 is completed, the even image data DA2 are supplied for the D/A converter 502 together with the inversion signal RVS. The D/A converter 502 selects the data voltages corresponding to the image data DA2 from the positive polarity gray voltages V+ and outputs the selected data voltages to the output buffer 503.

Subsequently, the signal controller 600 supplies the load signal LOAD for the output buffer 503, changes the state of the data selection signal DS1 from the high state into the low state, and changes state of the data selection signal DS2 from the low state into the high state. Accordingly, the odd transistors $T_1, T_3, T_5, \ldots, T_{2l-1}$ are turned off, while the even transistors T2, T4, T6, . . . , T2*l* are turned on such that the data voltages corresponding to the even image data DA2 from the output buffer 503 are applied to the even data lines $D_2, D_4, D_6, \ldots, D_{2l}$. At the same time, the signal controller 600 changes the value of the common voltage $V_{com}$ from the low value into the high value in accordance with the polarity change of the data voltages for the image data DA2.

Accordingly, the data voltages with the positive polarity are applied to the even pixels of the LC panel assembly 300 via the even data lines $D_2, D_4, \ldots, D_{2l}$ and the common voltage $V_{com}$ applied to the panel assembly 300 is changed from the high value to the low value at the same time.

According to this embodiment, the signal controller 600 controls the signals such that the state of the inversion signal RVS for the odd image data DA1 is different from that for the even image data DA2 and the period of the inversion signal RVS is equal to two horizontal periods. Furthermore, the signal controller 600 controls the signals such that the phase of the common voltage $V_{com}$ is delayed by ¼ period with respect to the phase of the inversion signal RVS to differ the polarity of the data voltages for the odd pixels from that for the even pixels. As shown in FIG. 4, the polarity of the inversion signal RVS is changed at a time between the transmissions of the odd image data DA1 and the even image data DA2 and the value of the common voltage $V_{com}$ is changed at a time between image data for adjacent columns outputted from the signal controller 600.

A dual gate type LCD according to an embodiment of the present invention will be described with reference to FIGS. 5 and 6.

Figure 5:
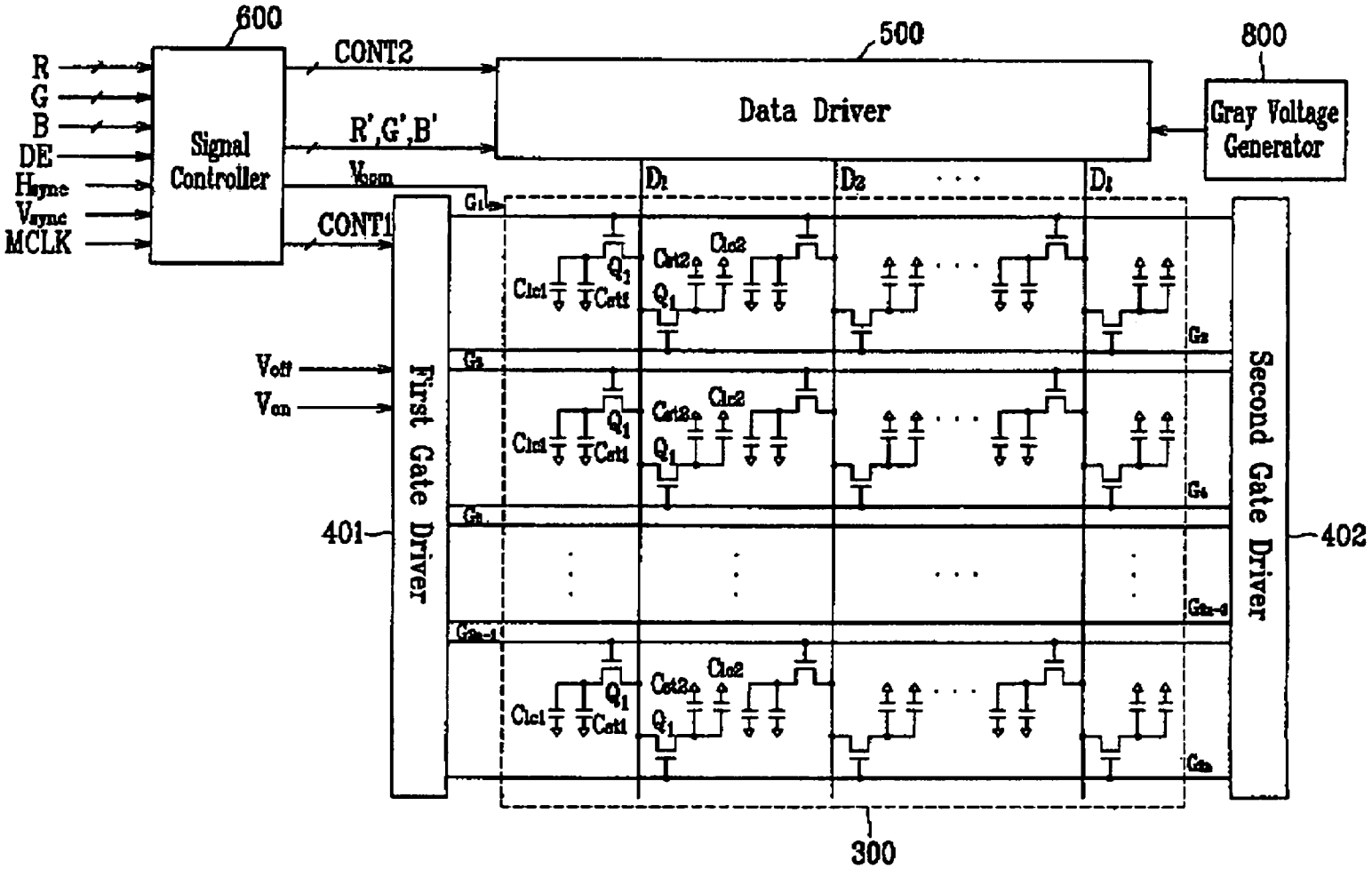
FIG. 5 is a block diagram of an LCD of a dual gate type according to another embodiment of the present invention.
Figure 6:
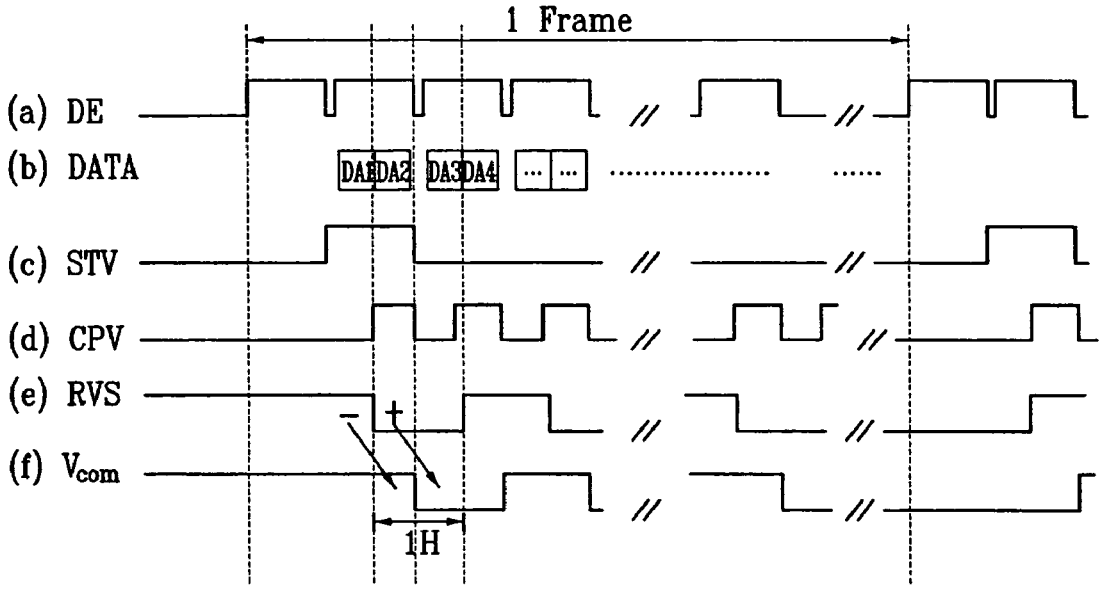
FIG. 6 is a time chart of an LCD of a dual gate type according to another embodiment of the present invention.

FIG. 5 is a block diagram of a dual gate type LCD according to an embodiment of the present invention and FIG. 6 is a timing chart of an LCD of a dual gate type according to another embodiment of the present invention.

Referring to FIG. 5, an LCD according to this embodiment includes an LC panel assembly 300 having a structure different from that shown in FIG. 1 and two gate drivers 401 and 402 located on left and right sides of the LC panel assembly 300 instead of the transmission gate unit 750 shown in FIG. 1. The LCD also includes a data driver 500 connected to the LC panel assembly 300, a gray voltage generator 800 connected to the data driver 500, and a signal controller 600 controlling the above elements.

As shown in FIG. 5, two gate lines are assigned to one pixel row, one connected to odd pixels and the other connected to even pixels. A pair of adjacent odd and even pixels are connected to one data line. Accordingly, as compared with the LCD shown in FIG. 1, the number of the gate lines $G_1$-$G_{2n}$ is increased twice, but the number of the data lines $D_1$-$D_m$ is decreased to half. This configuration of the LCD enables to differentiate the application time of data voltages for the odd pixels and the even pixels.

Next, the display operation of the LCD shown in FIG. 5 will be described in detail with reference to FIGS. 5 and 6.

When the vertical synchronization start signal STV is applied to the first gate driver 401, the first gate driver 401 selects the gate-on voltage $V_{on}$ between two voltages $V_{on}$ and $V_{off}$ supplied from the driving voltage generator 700 and outputs the gate-on voltage $V_{on}$ to a first gate line $G_1$, while it outputs the gate-off voltage $V_{off}$ to the other gate lines $G_3$-$G_{2n-1}$. At this time, the second gate driver 402 outputs the gate-off voltage $V_{off}$ to the even gate lines $G_2$-$G_{2n}$. Then, all switching elements Q1 connected to the first gate line $G_1$ are turned on, and then the data voltages are applied to the odd pixels in the first row through the data lines $D_1$-$D_m$.

After the charging of LC capacitors $C_{LC1}$ and storage capacitors $C_{ST1}$ is completed, the first gate driver 401 applies the gate-off voltage $V_{off}$ to the first gate line $G_1$, while the second gate driver 402 applies the gate-on voltage $V_{on}$ to the second gate line $G_2$. Then, the switching elements $Q_2$ connected a second gate line $G_2$ are turned on to transmit the data signals to the even pixels via the data lines $D_1$-$D_m$. At that time, the state change of the gate signal applied to the first gate line $G_1$ functions as a carry signal making the second gate driver 402 start application of the gate-on voltage $V_{on}$, and, on the contrary, the state change of the gate signal applied to the second gate line $G_2$ functions as a carry signal for the first gate driver 401.

Consecutively, the gate driver 401 applies the gate-on voltage $V_{on}$ to the third gate line $G_3$, and so on, thereby repeating the above operations.

In this manner, when the data signals are applied to the switching elements $Q_2$ connected to a last gate line $G_2$, the scanning for one frame is completed.

In this embodiment, the gate-on voltage $V_{on}$ is sequentially applied to two gate lines for driving all pixels in a row. Therefore, the period of the gate clock signal CPV is decreased to half as compared with that shown in FIG. 4. As shown in FIG. 6, when the gate clock signal CPV is in the high state, the first gate driver 401 applies the gate-on voltage $V_{on}$ to the odd gate lines $G_1$-$G_{2n-1}$, while the second gate driver 402 applies the gate-on voltage $V_{on}$ to the even gate lines $G_2$-$G_{2n}$ when the gate clock signal CPV is in the low state.

As described above, when the polarity inversion of the data voltages as well as the common voltage modulation is performed, the inversion signal has a period equal to two horizontal periods and a polarity reversed at a time between the odd data and the even data. Furthermore, the phase of the common voltage is delayed by ½ horizontal period, as compared with that of the inversion signal. Therefore, flicker phenomenon generated due to the line inversion is prevented and the image quality of an LCD is increased.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. An apparatus for driving a liquid crystal display including a plurality of pixels connected to gate lines and data lines and arranged in a matrix, the apparatus comprising:

a gray voltage generator generating a plurality of gray voltages;

a data driver selecting data voltages corresponding to image data from the gray voltages and applying the data voltages to the pixels; and a signal controller transmitting the image data for the data driver and generating and outputting control signals for controlling the image data to the data driver, wherein the data voltages include first data voltages for odd pixels and second data voltages for even pixels, the image data include the first image data for the first data voltages and the second image data for the second data voltages, the data driver applies the first data voltages and the second data voltages to the pixels in turn for a horizontal period, the control signals include an inversion signal for reversing the polarity of the first and the second data voltages and a common voltage applied to the pixels having a magnitude varying dependent on the polarity of the data voltages, and the signal controller changes a state of the inversion signal between an end of the transmission of the first image data and a start of the transmission of the second image data and the polarity of the common voltage between an end of the application of the data voltages for a row and a start of the application of the data voltages for a next row.

2. The apparatus of claim 1, wherein a phase of the common voltage is delayed by half of a horizontal period with respect to a phase of the inversion signal.

3. The apparatus of claim 1, wherein a period of the inversion signal and a period of the common voltage are equal to two horizontal periods.

4. A liquid crystal display comprising:

a plurality of pixels arranged in a matrix;

a plurality of odd and even data lines and gate lines transferring signals to the pixels;

a gray voltage generator generating a plurality of gray voltages;

a data driver selecting data voltages corresponding to image data from the gray voltages and applying the data voltages to the pixels; and a transmission gate unit including a plurality of odd switching elements connected to the odd data lines and a plurality of even switching element connected to the even data lines, and connected to the data driver; and a signal controller transmitting the image data to the data driver and generating and outputting control signals for controlling the image data to the data driver and the transmission gate unit, wherein the odd switching elements and the even switching elements are connected to each other in pairs, the data voltages include first data voltages for odd pixels and second data voltages for an even pixels, the image data include the first image data for the first data voltages and the second image data for the second data voltages, the data driver applies the first data voltages and the second voltages to the pixels in turn for a horizontal period, the signal controller controls the transmission gate unit to alternately turn on the odd switching elements and the even switching elements such that the first data voltages and the second data voltages are applied to the corresponding pixels, the control signals include an inversion signal for reversing the polarity of the first and the second data voltages and a common voltage applied to the pixels having a magnitude varying dependent on the polarity of the data voltages, and the signal controller changes a state of the inversion signal between an end of the transmission of the first image data and a start of the transmission of the second image data and the polarity of the common voltage between an end of the application of the data voltages for a row and a start of the application of the data voltages for a next row.

5. The liquid crystal display of claim 4, wherein a phase of the common voltage is delayed by half of a horizontal period with respect to a phase of the inversion signal.

6. The liquid crystal display of claim 4, wherein a period of the inversion signal and a period of the common voltage are equal to two horizontal periods.

7. The liquid crystal display of claim 6, wherein the control signals further includes a first switching driving signal driving the odd switching elements and a second switching driving signal driving the even switching elements, and the signal controller alternately applies the first switching driving signal and the second driving signal to the odd switching elements and the even switching elements.

8. A liquid crystal display comprising:

a plurality of odd and even pixels and arranged in a matrix, each pixel including a switching element;

a plurality of first gate lines connected to the odd pixels;

a plurality of second gate lines connected to the even pixels;

a plurality of data lines connected to the pixels;

a gray voltage generator generating a plurality of gray voltages;

a first gate driver connected to the first gate lines to drive the switching elements of the odd pixels;

a second gate driver connected to the second gate lines to drive the switching elements of the even pixels;

a data driver selecting data voltages corresponding to image data from the gray voltages and applying the data voltages to the pixels; and a signal controller transmitting the image data to the data driver and generating and outputting control signals for controlling the image data to the data driver, wherein the data voltages include first data voltages for odd pixels and second data voltages for an even pixels, the image data include the first image data for the first data voltages and the second image data for the second data voltages, each pair of the first and the second gate lines connected to the odd and even pixels in a row are alternately supplied with a gate-on voltage from the first and the second gate drivers, respectively, to turn on the switching elements connected thereto for one horizontal period, the data driver outputs the first voltages for the odd pixels during a period that the first switching elements are turned on and outputs the second voltages for the even pixels during a period that the second switching elements are turned on, the control signals include an inversion signal for reversing the polarity of the first and the second data voltages and a common voltage applied to the pixels having a magnitude varying dependent on the polarity of the data voltages, and the signal controller changes a state of the inversion signal between an end of the transmission of the first image data and a start of the transmission of the second image data and the polarity of the common voltage between an end of the application of the data voltages for a row and a start of the application of the data voltages for a next row.

9. The liquid crystal display of claim 8, wherein a phase of the common voltage is delayed by half of a horizontal period with respect to a phase of the inversion signal.

10. The liquid crystal display of claim 8, wherein a period of the inversion signal and a period of the common voltage are equal to two horizontal periods.

11. The liquid crystal display of claim 8, wherein the odd pixels and the even pixels are connected to the data lines in pairs.

12. A method of driving the liquid crystal display including a plurality of odd and even pixels arranged in a matrix, the method comprising:

supplying a first image data to the odd pixels, an inversion signal to a data driver, and a common voltage to the odd and even pixels;

reversing a state of the inversion signal between an end of the transmission of the first image data and a start of the transmission of a second image data;

supplying the second image data to the even pixels; and reversing a state of the common voltage between an end of the application of the data voltage for a first row and a start of the application of a data voltage for a next row.

* * * * *